US007997625B2

(12) United States Patent
Dean

(10) Patent No.: US 7,997,625 B2
(45) Date of Patent: Aug. 16, 2011

(54) SECURITY DEVICE

(75) Inventor: Julia Ruth Dean, Hampshire (GB)

(73) Assignee: De La Ru International Limited, Hampshire (GB)

( * ) Notice: Subject to any disclaimer, the term of this patent is extended or adjusted under 35 U.S.C. 154(b) by 748 days.

(21) Appl. No.: 10/576,727

(22) PCT Filed: Nov. 3, 2004

(86) PCT No.: PCT/GB2004/004644

§ 371 (c)(1),
(2), (4) Date: May 4, 2006

(87) PCT Pub. No.: WO2005/047013

PCT Pub. Date: May 26, 2005

(65) Prior Publication Data

US 2007/0132227 A1 Jun. 14, 2007

(30) Foreign Application Priority Data

Nov. 4, 2003 (GB) ..... 0325729.2

(51) Int. Cl.
*B42D 15/00* (2006.01)
*B42D 15/10* (2006.01)

(52) U.S. Cl. ..... 283/91; 283/72; 283/93; 283/114

(58) Field of Classification Search ..... 283/72, 283/91, 93, 114
See application file for complete search history.

(56) References Cited

U.S. PATENT DOCUMENTS

| | | | | |
|---|---|---|---|---|
| 3,887,742 A | | 6/1975 | Reinnagel | |
| 4,307,899 A | * | 12/1981 | Hoppe | 283/110 |
| 5,449,200 A | | 9/1995 | Andric et al. | |
| 6,089,614 A | | 7/2000 | Howland et al. | |
| 6,471,247 B1 | | 10/2002 | Hardwick et al. | |
| 6,505,779 B1 | | 1/2003 | Power et al. | |
| 2002/0027361 A1 | | 3/2002 | Hardwick et al. | |

FOREIGN PATENT DOCUMENTS

| | | |
|---|---|---|
| GB | 894081 | 4/1962 |
| GB | 2 350 319 A | 11/2000 |
| JP | A-2003-305794 | 10/2003 |
| WO | WO 02/37208 A3 | 5/2002 |

OTHER PUBLICATIONS

Understanding Halftones, Mar. 2001 http://web.archive.org/web/20010413120831/http://www.designer-info.com/DTP/understanding_halftones.htm.*

Feb. 14, 2011 Communication Pursuant to Article 94(3) in European Application No. 04 798 373.9.

* cited by examiner

*Primary Examiner* — Shelley Self
*Assistant Examiner* — Kyle Grabowski
(74) *Attorney, Agent, or Firm* — Oliff & Berridge, PLC

(57) ABSTRACT

A security device having one or more printed or transferred first areas, each first area having one or more first colors; and one or more printed or transferred second areas, each second area having one or more second colors. At least one of the first an second areas has a discontinuous pattern, and the first area or areas surrounds the second area or areas, each first area being distinguishable from the second area or areas. The first area(s) and/or second area(s) define an image. A camouflage pattern is provided over the image and at least an adjacent region surrounding the image, the camouflage pattern having a color and pattern such that in combination with the first and second areas, it renders the image substantially invisible when viewed under reflected light but visible when viewed in transmission.

40 Claims, 3 Drawing Sheets

SECURITY DEVICE

BACKGROUND OF THE INVENTION

The invention relates to security devices for securing articles and documents of value such as banknotes, cheques, identity documents such as passports, and documents used for brand protection etc.

A wide variety of security devices have been used in the past, some applied directly to articles or documents and others provided in the form of labels which are then transferred onto the articles. These security devices are typically in printed and/or embossed form and define many different security designs. Other security features are embedded into documents during their manufacture such as watermarks and electrotypes.

U.S. Pat. No. 6,505,779 describes the provision of security indicia formed by at least partly transparent windows formed through a security document and which are detectable in transmitted light. Indicia are provided within the bounds of a security pattern acting to visually conceal the security indicia in reflected light. This invention is based on the principle that it is possible to hide or conceal small amounts of information within larger and visually confusing information structures. A disadvantage of this technique is that it utilizes a relatively large area of the document and also does not completely hide the security indicia.

There is a continuing need to provide new security features which are more difficult for counterfeiters and fraudsters to reproduce.

SUMMARY OF THE INVENTION

In accordance with a first aspect of the present invention, a security device comprises one or more printed or transferred first areas, each first area having one or more first colours;

one or more printed or transferred second areas, each second area having one or more second colours, wherein at least one of the first and second areas comprises a discontinuous pattern, and wherein the first area or areas surrounds the second area or areas, each first area being distinguishable from the second area or areas;

wherein the first area(s) and/or second area(s) define an image; and, a camouflage pattern provided over the image and at least an adjacent region surrounding the image, the camouflage pattern having a colour and pattern such that in combination with the first and second areas, it renders the image substantially invisible when viewed under reflected light but visible when viewed in transmission.

In most cases, the first area(s) defines a negative image which is the second area. This second area(s) comprises a discontinuous pattern. However, in some examples, the second area(s) defines a positive image and is surrounded by a discontinuous pattern in the first area(s).

In this context, a discontinuous pattern comprises discrete printed or transferred elements over a background. The background regions are defined as being the spaces between the printed or transferred elements.

We have found surprisingly that the discontinuous pattern, which otherwise would be very obvious in reflection, can be hidden when overprinted with a suitable camouflage pattern. In particular, the eye is confused if the camouflage pattern comprises lines of a similar lightness to that of the background regions between elements of the discontinuous pattern. Furthermore the camouflage pattern should normally have elements with at least one dimension similar to those of the background regions between elements of the discontinuous pattern.

However, we have also identified cases where the line width of the elements within the camouflage pattern are much greater than those of the background regions but are similar to those of the discontinuous elements themselves, i.e. the camouflage pattern is a "white line" type of design.

In transmission, the camouflage pattern is no longer clearly visualised over the first and/or second area(s) defining the image due to the partial transparency of the camouflage print and therefore it ceases to act as a disguise, and the image is visualised. In the case of negative image examples, if the size of the individual elements of the discontinuous pattern is sufficiently small, then the overall shape of the negative image is perceived rather than the individual elements themselves.

Some advantages over the prior art are that the invention can be fabricated as a large feature which can be easily discerned in transmission by the public without requiring special verification equipment but is largely hidden in reflection; and can be cost effectively and efficiently produced without the need to use special equipment and/or materials on a paper substrate or suitably coated polymer substrate. It enables a transmission print feature to be produced on documents printed using multi-unit presses. The feature adds to the security of documents containing other transmission features because it encourages the public to view documents in transmission, thus ensuring other transmission features e.g. watermarks, electrotypes, embedded threads, windowed threads, traditional see-through features etc. within the document are also checked. In a preferred embodiment, the design of the security device is complemented by features such as electrotypes and see-through features etc. e.g. an apple is revealed in transmission within both the feature and the electrotype. The feature is more difficult to counterfeit compared to the prior art as it cannot be reproduced by colour copying or DTP and cannot readily be resolved into its components to allow counterfeiting by photographic or line separation and printing techniques.

Preferably the discontinuous pattern defining one of the first and second areas is approximately the same colour(s) as the colour(s), of the other of the first and second areas. However, some of the elements making up the discontinuous pattern can be different colours. This is more important for lighter colours than for darker colours.

In all cases, the discontinuous pattern in the first or second area(s) should be of a greater lightness than that of the other area(s) and when viewed in transmission, the contrast between them is enhanced allowing visualisation of the image. In reflection, the contrast between the area of discontinuous pattern and the other area(s) is masked by the overprinted camouflage pattern as described above.

Contrast in this case is defined as being the difference in lightness of two or more areas as opposed to any difference in hue.

The discontinuous pattern typically comprises an array of dots, lines, squares or other small shapes such as alphanumerics, graphical shapes and the like or a combination thereof and will generally provide 50-80%, preferably 60-70%, coverage of the first or second area in which it is provided. The maximum lateral dimension of the individual elements defining the discontinuous pattern is dependent on the design but will typically be less than 1.5 mm, preferably less than 1 mm.

The discontinuous pattern can have either random, stochastic, or regular placement.

Conveniently, the elements of the discontinuous pattern are provided on a background which may be unprinted; previously printed with a flat tint or another discontinuous pattern which can either be out of register or in register with the one discontinuous pattern; or subsequently printed with another flat tint or another discontinuous pattern which can either be out of register or in register with the one discontinuous pattern. In the preferred approach, the background regions are unprinted.

The colour of the background regions is preferably white or a pale colour and, if printed, this could be achieved by printing at a low density. This enables a difference in contrast between the colour of the discontinuous pattern and that of the other area(s) so as to enable the hidden image to be seen clearly in transmission.

Preferably, the first or second area which does not comprise the discontinuous pattern is a solid colour or colours but it could also be broken up with fine unprinted lines or lines of a different colour, or it could be a dense halftone.

In all cases if both first and second areas are printed in a pale tint over a white or pale background, the discontinuous pattern is more readily disguised by the camouflage pattern over-print. However, the image is more difficult to see in transmission as there is insufficient contrast between the discontinuous pattern and the other area.

The area(s) can be applied by any conventional printing method such as one of intaglio, litho, gravure, screen, flexo, ink jet, laser, toner transfer, or digital printing, or dye diffusion or it can be applied as a partially demetallized foil, a holographic patch printed film, a set of transferred elements etc. The areas are preferably (but not necessarily) printed simultaneously. If a foil or holographic patch is used for the discontinuous pattern, the other area(s) may comprise a non-demetallised film.

The hidden image(s) can define simple shapes such as circles or squares or more complex shapes such as stars, alphanumeric indicia, or other images such as a butterfly, apple or bird. An image has typical dimensions in the range 10-15 mm×10-15 mm but could be from 2.5 mm to 30 mm or more in its minimum lateral dimension.

Each first or second area can either be a single colour, two or more colours, or rainbowed colours. In the case of printed areas, the ink can be from a full range of inks including metallic, coloured, optically variable, thermochromic, photochromic, luminescent, etc. In addition to the visible components the ink may additionally be provided with machine readable components i.e. magnetic, luminescent, anti-stokes, IR-readable etc.

The colour or colours of the areas should be chosen to provide relatively high contrast with the background regions between elements of the discontinuous pattern. This ensures that there is relatively high contrast between the first and second areas. Measurements of examples have shown that the difference in lightness $\Delta L^*$ between the discontinuous pattern and adjacent area(s) should be 5-30 and more preferably 10-20.

The image is visualised in transmission due to the contrast between the discontinuous pattern and the other area(s).

The first area(s) can either be used to provide a distinct stand-alone security device or can be incorporated into a larger design. The larger design could include other security features commonly found on security documents such as anti-copy structures, see-through features, microtext, etc. or other examples of the invention as herein described.

The camouflage pattern is preferably selected so that one dimension of the design, e.g. the thickness of a line making up a line pattern, is approximately the same as the width of background regions defined between elements of the discontinuous pattern. For example, for a black line type of design at least one dimension of the line printed should be approximately the same width as that of the background areas between elements of the discontinuous pattern. However, for a white line type of design, at least one dimension of the unprinted area between the printed lines should be approximately the same width as the elements of the discontinuous pattern.

Preferably, the colour of the camouflage pattern is chosen to match that of the background regions visible through the discontinuous pattern, e.g. white or a pale tint.

The camouflage pattern can either be an integrated design or a stand-alone discreet design. The camouflage pattern can either be regular or irregular and may consist of one or more of lines, dots, squares, or other small shapes. Preferred designs are those which contain distinctive images or patterns. Other preferred designs are those which have an additional distinct visual element, e.g. indicia within the camouflage pattern.

The camouflage pattern may be printed using one of litho, gravure, screen, flexo, ink jet, laser, toner transfer, or digital printing, or dye diffusion. In the preferred embodiment, a white intaglio ink is used.

Preferred camouflage patterns have elements with a width in the range of 0.1-1.5 mm and a separation of 0.1-4 mm, preferably a width of 0.25-1.25 mm and a separation of 0.25-3 mm. It has been found surprisingly that even when the camouflage pattern is provided at a high ink coverage, a negative image can still be observed in transmission provided that the covering ink is partially transparent. It is also of benefit if the camouflage pattern contains distinctive images or patterns itself. This is because of perceptual organisation when the eye views an image, whereby the brain tends to process images on the basis of grouping and, for example, will not clearly perceive a discontinuous pattern below.

A second, similar device could be provided on the opposite side to the one device. This second device could be printed so that the discontinuous pattern is in perfect register with that of the one device, alternatively an inverse of the discontinuous pattern could be printed again in perfect register. This printing in perfect register could be viewed from the second side as a conventional see-through feature and conveniently enables a check to be made that the security document was printed on a common impression press. The second image may or may not be camouflaged. In this case, it would be possible for the two "images" to define respective image elements of a common, single image.

Generally, any print on the second side which is out of register with the discontinuous pattern, should be of low print density in the region of the device.

In accordance with a second aspect of the present invention, a security device comprises one or more printed or transferred first areas; one or more printed or transferred second areas, wherein at least one of the first and second areas defines a discontinuous pattern, and wherein the first area or areas surrounds the second area or areas, wherein the areas are formed from one or more reflective media, and wherein the form of the discontinuous pattern and the other area(s) are chosen such that the image is not visible under reflected light but is visible when viewed in transmission.

We have found surprisingly that it is possible to design a discontinuous pattern in this case, typically with a coverage of more than 70%, in which the image is hidden in reflection but visible in transmission. This has an additional advantage over devices according to the first aspect of the invention in that it gives an added level of security with respect to colour copying and DTP counterfeiting. This approach works because when a discontinuous reflective pattern is viewed in reflection, providing the discontinuous elements are sufficiently small, the eye cannot discern the background areas within the pattern and between the discontinuous elements. There is sufficient contrast in transmission between the surrounding first area(s), and the second area(s) such that the shape of the image can be seen in transmission.

The first and second area(s) are typically printed, most commonly at the same time, using a reflective medium such as a metallic ink. However, other media such as a metallic foil or holographic applied feature could be used or even a highly reflective (eg high gloss and colour saturated) colour such as an iridescent material or OVI.

Preferably, the elements defining the discontinuous pattern each have at least one lateral dimension exceeding 0.5 mm.

In other respects, the preferred features of this device are similar to those for devices according to the first aspect of the invention.

In one modified form of the second aspect of the invention, the first and second areas are embossed with an image. This provides a further security feature such as a latent image. The embossing does not detract from there being sufficient contrast between the first and second areas. The embossing may be carried out by any known method such as are used for intaglio embossing latent images, anti-copy line structures, relief emboss, etc.

In another approach, a device according to the second aspect of the invention may be overprinted with an image in a contrasting colour. This image or design may be printed typically by intaglio but also by litho, gravure, screen, flexo, etc. The design may be of the camouflage pattern type described above or any other design providing the line density is such that the image can be viewed in transmission.

In all cases, the substrate will be sufficiently translucent to enable the device to be viewed in transmission.

The security device in all aspects of the invention may be provided in an area of a substrate with reduced opacity as compared with other parts of the substrate although this is not essential. In the case of a paper substrate, this reduction in opacity can be achieved by a variety of techniques such as those described in EP-A-0388090, GB-A-2282611 and GB-A-2283026 for producing an area of greater transparency during manufacture of the substrate or it could be formed during a post processing operation. This has the advantage that the device can be viewed easily in transmission without specialized viewing equipment.

Instead of a paper substrate, a polymer substrate could also be used.

The security device could be printed onto a substrate such as paper previously coated with a protective coating such as Platinum® or which is subsequently coated with a protective varnish.

The devices can be provided on documents of value such as banknotes, ID cards and the like or as labels for adhering to articles or documents via a suitable adhesive.

BRIEF DESCRIPTION OF THE DRAWINGS

Some examples of security devices according to the invention will now be described with reference to the accompanying drawings; in which.

DETAILED DESCRIPTION OF PREFERRED EMBODIMENTS

Figure 1:
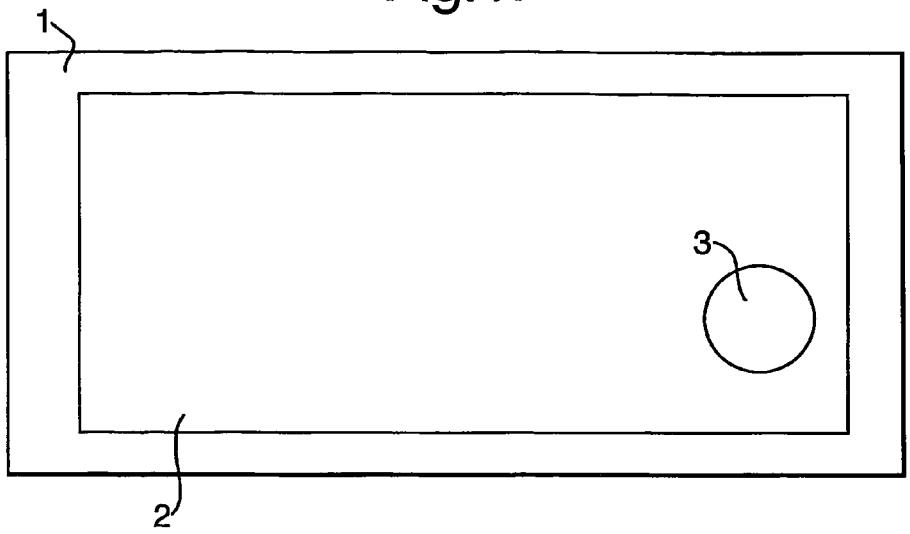
FIG. 1 is a schematic, plan of a security document provided with a security device.

FIG. 1 represents a plan view of a security document 1 such as a banknote. Generally, printed information typical of such secure documents e.g. denomination, currency, portraits, anti-copy line structures etc. are located in area 2. The example of a security device according to the present invention 3 is located within area 2.

EXAMPLE 1

FIGS. 2A-2C

The elements of this security device were printed onto white paper of approximately 90 gsm and with CIE L*a*b* of 83, −1.5, 3.1 respectively. In this first example, a solid print first area 5 litho printed in a deep blue colour Pantone 294U with L* of 39 defines a negative image 6 in the form of a star in a second area. The star 6 is filled with a discontinuous pattern 4 printed in approximately the same colour as the solid area 5. The discontinuous pattern 4 is defined by an array of dots which are 0.6 mm diameter and are spaced to give an all over ink coverage of approximately 70%. The screen angle is 45°. Discontinuous pattern 4 is shown magnified in FIG. 2B. The discontinuous pattern 4, when measured on a spectrophotometer together with the associated unprinted background regions has L* of approximately 52. The camouflage pattern 40 illustrated in FIG. 2C was intaglio printed over the areas in FIG. 2A in white ink. This camouflage pattern was designed so that when printed in white ink, the eye is not able to resolve the shape of the underlying negative image 6 when viewed in reflection. The ink coverage of the camouflage pattern is approximately 70%. The line width of elements in the camouflage pattern are typically 0.250 mm. When viewed in reflection, from a normal reading distance, the image 6 is not perceived. When viewed in transmission, the star shaped outline 6 filled with discontinuous pattern 4 is clearly seen.

EXAMPLE 2

This example was printed as per example 1. The same discontinuous pattern 4 was used however instead of unprinted background regions between the dots a yellow tint Pantone 100U was used to fill between the dots. Discontinuous pattern 4 when measured on a spectrophotometer together with the associated printed background regions has a L* of approximately 49. Camouflage pattern 2C was intaglio printed in approximately the same colour as Pantone 100U. In this example, when viewed in reflection from a normal reading distance the image 6 could not be perceived. When viewed in transmission, the star shaped outline 6 filled with discontinuous pattern 4 could be clearly seen.

EXAMPLE 3

This example was printed as per example 1 but onto blue tinted paper of approximately 90 gsm and with L*a*b* of 80, −4.6, −4.4 respectively. The same discontinuous pattern 4 and camouflage pattern 2C were used. In this example, when viewed in reflection from a normal reading distance the image 6 could not be perceived. When viewed in transmission, the star shaped outline 6 filled with discontinuous pattern 4 could be clearly seen.

EXAMPLE 4

FIGS. 3A-3C

Figure 3A:
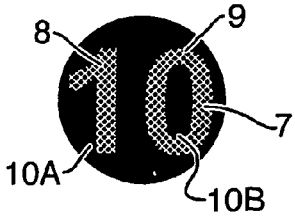
FIGS. 3A-3C are similar to FIGS. 2A-2C but of a second example.
Figure 3B:
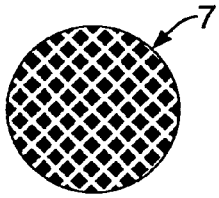
Figure 3C:
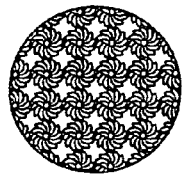

The elements of this security device were printed onto white paper of approximately 90 gsm. FIG. 3A illustrates solid print first areas 10A,10B litho printed in a purple colour Pantone 520U rainbowing into a green colour 562U defining two negative images 8,9 forming the number "10" in respective second areas. Each negative image 8,9 is filled with a discontinuous pattern 7 which is also rainbowed in the same manner as the solid print areas 10A,10B. The discontinuous pattern 7 is defined by an array of squares which are 0.4 mm×0.4 mm and are surrounded by an unprinted border to give an ink coverage of approximately 60%. The screen angle is 45°. Discontinuous pattern 7 is shown magnified in FIG. 3B. The camouflage pattern illustrated in FIG. 3C was intaglio printed over the areas of FIG. 3A in white ink. This camouflage pattern, which consists of a number of replicated distinctive design elements, was designed so that when printed, the eye is not able to resolve the shape of the image 8,9. The ink coverage of the camouflage pattern is approximately 70%. When viewed in reflection, from a normal reading distance the images 8,9 are not perceived. When viewed in transmission, the "1" and "0" shaped outlines 8,9 filled with discontinuous pattern 7 are clearly seen.

In a further example the "1" and "0" shaped outlines 8, 9 could be filled with discontinuous patterns 4 and 7 respectively or alternatively the discontinuous patterns could comprise repeated indicia related to the shaped outlines 8, 9, e.g. 1's in the "1" and 0's in the "0".

EXAMPLE 5

FIGS. 4A-4H

Figure 4A:
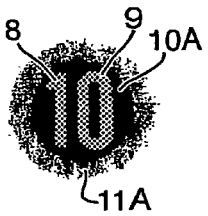
FIGS. 4A-4H illustrate further examples of security devices before overprinting with a camouflage pattern.
Figure 4B:
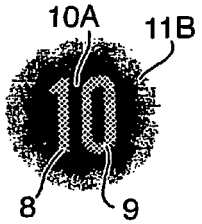
Figure 4C:
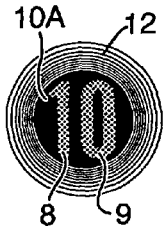
Figure 4D:
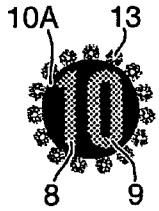
Figure 4E:
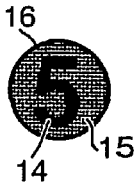
Figure 4F:
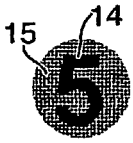
Figure 4G:
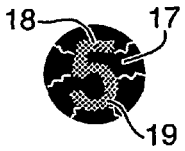
Figure 4H:
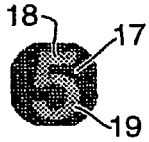

In the previous examples the first areas 5 and 10A,10B have been simple defined shapes. More complex shapes can be used. FIG. 4 shows some illustrative examples. In FIGS. 4A and 4B, similar to FIG. 3A, the first area 10A bleeds into a surrounding print area 11A,11B respectively. In FIGS. 4C and 4D, the first area 10A is integrated into a larger design 12,13 respectively. In FIGS. 4E and 4F the solid print area 14 and the discontinuous pattern 15 are reversed relative to the previous examples and therefore in transmission the defined image, a "5", is seen as a positive image rather than a negative image. In FIG. 4E the first area has a solid border 16 while FIG. 4F does not. In FIGS. 4G and 4H the first area 17 having some small breaks defines a negative image 18 filled with a discontinuous pattern 19. In 4G these breaks are in the form of thin lines and in 4H the breaks are unprinted areas between a high coverage (>80%) half tone pattern. The first and second areas can be a single colour, rainbowed colours or a plurality of colours.

FIGS. 4A-4H illustrate the security device before overprinting with the camouflage pattern.

Figure 4I:
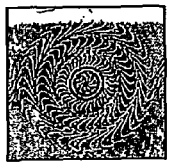
FIGS. 4I and 4J illustrate the appearance of a security device when viewed in reflection and transmission respectively.
Figure 4J:
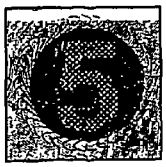
Figure 5A:
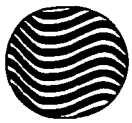
FIGS. 5A to 5E illustrate further examples of discontinuous patterns; and, FIG. 6 illustrates a further example of a camouflage pattern.
Figure 5B:
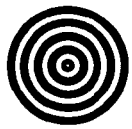
Figure 5C:
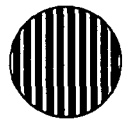
Figure 5D:
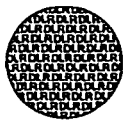
Figure 5E:
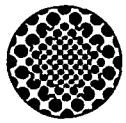

FIG. 4I illustrates the appearance of a device similar to FIG. 3A but in which the negative image is in the form of a "5" rather than a "10". FIG. 4I illustrates this device being viewed in reflection and it will be apparent that the image cannot be seen as it is hidden by the "spiral" camouflage pattern printed in white intaglio ink. FIG. 4J illustrates the device when viewed in transmission and here the image of the "5" can clearly be seen because the camouflage pattern is no longer strongly visible.

In the previous examples the discontinuous patterns 4 and 7 etc have been based on dots and squares. Many other designs may also be used provided they give an ink coverage of 50-80%. Some illustrative examples are shown in FIGS. 5A-5E at an enlarged scale. The colour of these discontinuous patterns should be approximately that of the other areas. However, some of the elements of the discontinuous pattern may be of a different colour or colours providing that these colours do not dominate the overall effect.

EXAMPLE 6

FIG. 6

Figure 2A:
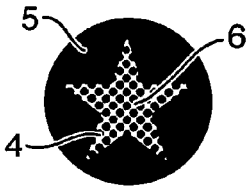
FIGS. 2A, 2B and 2C illustrate a negative image, an enlarged view of the discontinuous pattern, and a camouflage pattern, respectively, of a first example of a security device.
Figure 6:
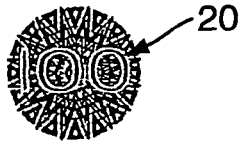

A preferred method of adding a distinct visual element in the form of a visually distinctive pattern or indicia to a camouflage pattern is to include a relatively large indicia 20 within the design. An example is shown in FIG. 6. When this design is printed in white intaglio over an image such as shown in FIG. 2A and viewed in reflection from a normal reading distance, the image 6 is not perceived. When viewed in transmission, the star shaped outline 6 filled with discontinuous pattern 4 is clearly seen. The reason that this camouflage pattern is particularly effective in disguising image 6 in reflection, is that it gives the eye a definite image 20 to focus on and therefore distracts the eye from distinguishing the image 6.

EXAMPLE 7

Figure 2B:
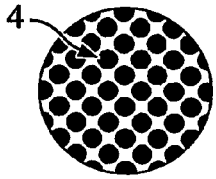
Figure 2C:
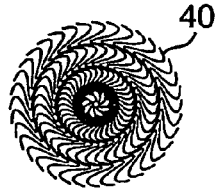

The arrangement of elements in this example is the same as for FIG. 2. The elements of this security device were printed onto white paper of approximately 90 gsm. In this example, however, a solid print first area 5 screen printed in a metallic silver ink with a gloss value of 60 gloss units defines a negative image 6 in the form of a star. The star 6 is filled with a discontinuous pattern 4 printed in approximately the same colour as the solid area. The discontinuous pattern 4 is defined by an array of dots which are 0.6 mm diameter and are spaced to give an all over ink coverage of approximately 70%. The screen angle is 45°. Discontinuous pattern 4 is shown magnified in FIG. 2B. Due to the high gloss of the metallic ink, when viewed in reflection, from a normal reading distance the image 6 is not perceived. When viewed in transmission, the star shaped outline filled with discontinuous pattern 4 is clearly seen. In this case no camouflage pattern is used as the reflective properties of the ink hide the image.

the invention claimed is:

1. A security device provided on a substrate, comprising:

at least one printed or transferred first area, each first area having at least one first color;

at least one printed or transferred second area on a same side of the substrate as the first area, each second area having at least one second color, wherein at least one of the first and second areas comprises a discontinuous pattern, wherein the first area surrounds the second area, each first area being distinguishable from the second area, the first area defining a border of the second area, and wherein at least one of the first area and the second area defines an image; and a camouflage pattern provided over the image and at least an adjacent region surrounding the image on the same side of the substrate as the first and second areas, the camouflage pattern having a color and a pattern such that in combination with the first and second areas, the camouflage pattern renders the image substantially invisible when viewed under reflected light but visible when viewed in transmission, wherein, elements of the camouflage pattern and background areas between elements of the discontinuous pattern are approximately a same size, or the elements of the camouflage pattern are of a similar size to the elements of the discontinuous pattern.

2. A device according to claim 1, wherein the discontinuous pattern comprises an array of dots which is either regular or stochastic.

3. A device according to claim 2, wherein the discontinuous pattern comprises a half-tone dot array.

4. A device according to claim 2, wherein each dot has a maximum lateral dimension of less than 1.5 mm.

5. A device according to claim 4, wherein the maximum lateral dimension is less than 1 mm.

6. A device according to claim 1, wherein the discontinuous pattern comprises a regular array of similarly sized and shaped dots.

7. A device according to claim 1, wherein the discontinuous pattern comprises an array of circles, squares, lines, indicia including alphanumerics, graphical shapes and the like.

8. A device according to claim 1, wherein the discontinuous pattern is substantially a same color as the color, or a major color, of another of the areas.

9. A device according to claim 1, wherein the discontinuous pattern has more than one color, a major color of the discontinuous pattern being substantially a same color as the color, or a major color, of another of the areas.

10. A device according to claim 1, wherein the elements of the discontinuous pattern cover an area of 50-80% of the first or second area in which the discontinuous pattern is provided.

11. A device according to claim 10, wherein the area is 60-70% of the first or second area in which the discontinuous pattern is provided.

12. A device according to claim 1, wherein the camouflage pattern comprises a line pattern.

13. A device according to claim 1, wherein at least one of the first and second areas exhibits a rainbow color variation.

14. A device according to claim 1, wherein the camouflage pattern defines elements having a width in the range 0.1-1.5 mm and a separation of 0.1-4 mm.

15. A device according to claim 14, wherein the width is 0.25-1.25 mm and the separation is 0.25-3 mm.

16. A device according to claim 1, wherein the camouflage pattern has an ink coverage of 50-90%.

17. A device according to claim 16, wherein the ink coverage is 55-75%.

18. A device according to claim 1, wherein the color of the camouflage pattern and a color of background regions between elements of the discontinuous pattern are same or similar.

19. A device according to claim 1, wherein the color of the camouflage pattern color contrasts with the first and second colors of the first and second areas.

20. A device according to claim 1, wherein the camouflage pattern includes a distinctive pattern or indicia.

21. A device according to claim 1, wherein the camouflage pattern comprises a black or white line design.

22. A device according to claim 1, wherein the camouflage pattern has been printed using one of intaglio, litho, gravure, screen, flexo, ink jet, laser, toner transfer, or digital printing, or dye diffusion.

23. A device according to claim 1, wherein the discontinuous pattern is formed by a partially demetallised metal layer.

24. A device according to claim 1, wherein the discontinuous pattern was formed by transfer of elements from a carrier.

25. A device according to claim 1, wherein the discontinuous pattern and other area(s) were printed simultaneously.

26. A device according to claim 1, wherein the color of the area adjacent to the discontinuous pattern contrasts with an apparent color of the discontinuous pattern so as to enable the image to be seen in transmission.

27. A device according to claim 1, wherein the first area forms part of a larger design printed on the substrate on which the security device is provided.

28. A device according to claim 1, wherein the first and second areas were printed using one or more of litho, gravure, screen, flexo, ink jet, laser, toner transfer, or digital printing, or dye diffusion.

29. A device according to claim 1, wherein the area not including the discontinuous pattern was provided as a foil or holographic patch.

30. A device according to claim 1, wherein the area not including the discontinuous pattern exhibit a rainbow color variation.

31. A device according to claim 1, wherein the area not including the discontinuous pattern is provided as one of a solid color or colors or a half-tone.

32. A device according to claim 31, wherein the solid color area is broken up with one or more fine lines.

33. A device according to claim 1, wherein the device is provided on a background with a flat tint.

34. A device according to claim 1, wherein the image comprises one or more geometric figures, alphanumeric characters and graphical designs.

35. A device according to claim 1, wherein the device is provided on a paper or polymer substrate.

36. A document or article carrying a security device provided on a substrate, comprising:

at least one printed or transferred first area, each first area having at least one first color;

at least one printed or transferred second area on a same side of the substrate as the first area, each second area having at least one second color, wherein at least one of the first and second areas comprises a discontinuous pattern, wherein the first area surrounds the second area, each first area being distinguishable from the second area, the first area defining a border of the second area, and wherein at least one of the first area and the second area defines an image; and a camouflage pattern provided over the image and at least an adjacent region surrounding the image on the same side of the substrate, the camouflage pattern having a color and a pattern such that in combination with the first and second areas, the camouflage pattern renders the image substantially invisible when viewed under reflected light but visible when viewed in transmission, wherein, elements of the camouflage pattern and background areas between elements of the discontinuous pattern are approximately a same size, or the elements of the camouflage pattern are of a similar size to the elements of the discontinuous pattern.

37. A document according to claim 36, wherein the security device is provided on an area of a document which is more transparent than other areas of the document.

38. A document according to claim 37, wherein the document or the article is a paper or a polymer substrate.

39. A document according to claim 36, wherein the document is a banknote.

40. A security label comprising a security device provided on a substrate, comprising:

at least one printed or transferred first area, each first area having at least one first color;

at least one printed or transferred second area on a same side of the substrate as the first area, each second area having at least one second color, wherein at least one of the first and second areas comprises a discontinuous pattern, wherein the first area surrounds the second area, each first area being distinguishable from the second area, the first area defining a border of the second area, and wherein at least one of the first area and the second area define an image;

a camouflage pattern provided over the image and at least an adjacent region surrounding the image on the same side of the substrate, the camouflage pattern having a color and a pattern such that in combination with the first and second areas, the camouflage pattern renders the image substantially invisible when viewed under reflected light but visible when viewed in transmission provided on a substrate, wherein, elements of the camouflage pattern and background areas between elements of the discontinuous pattern are approximately a same size, or the elements of the camouflage pattern are of a similar size to the elements of the discontinuous pattern; and an adhesive on the substrate.

* * * * *